US006858985B2

(12) United States Patent
Kraus et al.

(10) Patent No.: US 6,858,985 B2
(45) Date of Patent: Feb. 22, 2005

(54) LOW-PRESSURE GAS DISCHARGE LAMP

(75) Inventors: Albrecht Kraus, Kerkrade (NL); Bernd Rausenberger, Aachen (DE); Wilhelm Albert Groen, Einighausen (NL); Horst Dannert, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 125 days.

(21) Appl. No.: 09/811,640

(22) Filed: Mar. 19, 2001

(65) Prior Publication Data

US 2001/0024090 A1 Sep. 27, 2001

(30) Foreign Application Priority Data

Mar. 24, 2000 (JP) ..... 100 14 407

(51) Int. Cl.[7] ..... H01J 17/04
(52) U.S. Cl. ..... 313/631; 313/142
(58) Field of Search ..... 313/142, 141, 313/143, 144, 310, 311, 346 R, 361, 495, 631; 445/7

(56) References Cited

U.S. PATENT DOCUMENTS

| | | | | |
|---|---|---|---|---|
| 2,624,858 A | | 11/1953 | Greenlee | 313/201 |
| 5,057,740 A | * | 10/1991 | Kirkman-Amemiya | 313/296 |
| 5,325,024 A | * | 6/1994 | Piejak et al. | 315/248 |
| 5,327,049 A | * | 7/1994 | Smolka et al. | 315/248 |
| 5,604,410 A | * | 2/1997 | Vollkommer et al. | 313/607 |
| 5,801,482 A | * | 9/1998 | Verhaar et al. | 313/483 |
| 5,982,097 A | * | 11/1999 | Mehrotra et al. | 313/346 R |
| 6,137,225 A | * | 10/2000 | Heuvelmans et al. | 313/580 |
| 6,507,151 B1 | * | 1/2003 | Kraus et al. | 313/631 |

FOREIGN PATENT DOCUMENTS

| | | |
|---|---|---|
| EP | 0593311 A1 | 10/1993 |
| WO | WO9925001 | 10/1998 |
| WO | WO0033351 | 11/1999 |

OTHER PUBLICATIONS

J.Duarte et al, "Getting More from Fluorescent Lamps Through Resonant Converters", Proceedings of the International Conference on Industrial Electronics, Control, Instrumentation and Automation (IECON), Power Electronics and Motion Control, vol. 1 of 3, US, New York, IEEE, vol. Conf. 18, pp. 560–563.

* cited by examiner

*Primary Examiner*—David Martin
*Assistant Examiner*—Thanh S. Phan
(74) *Attorney, Agent, or Firm*—Dicran Halajian

(57) ABSTRACT

The invention relates to a low-pressure gas discharge lamp which includes at least one discharge vessel and at least two capacitive coupling-in structures and operates at an operating frequency f. In order to achieve a better efficiency in combination with a small structural volume, a high luminous flux, a low operating voltage, a low electromagnetic emission, a high resistance against switching transients and a long service life for the low-pressure gas discharge lamp, it is proposed to form each capacitive coupling-in structure from at least one dielectric having a thickness d and a dielectric constant $\epsilon$, each dielectric being subject to the condition $d/(f.\epsilon)<10^{-8}$ cm.s. A substantially larger amount of light can thus be generated per lamp length (lumen/cm).

13 Claims, 4 Drawing Sheets

LOW-PRESSURE GAS DISCHARGE LAMP

FIELD OF THE INVENTION

The invention relates to a low-pressure gas discharge lamp which includes at least one discharge vessel and at least two capacitive coupling-in structures and operates at an operating frequency f. The invention also relates to a device for the backlighting of a liquid crystal display wherein at least one such low-pressure gas discharge lamp serves as a light source and an optical system is provided for producing backlighting.

BACKGROUND OF THE INVENTION

Known gas discharge lamps consist of a vessel containing a filling gas wherein the gas discharge takes place, and usually two metallic electrodes which are sealed in the discharge vessel. An electrode supplies the electrons for the discharge, which electrons are subsequently applied to the external current circuit via the second electrode. The donation of the electrons generally takes place via thermionic emission (hot electrodes), although it may alternatively be brought about by an emission in a strong electric field or, directly, via ion bombardment (ion-induced secondary emission) (cold electrodes). In an inductive mode of operation the charge carriers are generated directly in the gas volume by means of an electromagnetic alternating field of high frequency (typically higher than 1 MHz in the case of low-pressure gas discharge lamps). The electrons travel along closed paths inside the discharge vessel; customary electrodes are absent in this mode of operation. In a capacitive mode of operation, capacitive coupling-in structures are used as electrodes. These electrodes are usually embodied so as to be insulators (dielectric materials) which, on one side, are in contact with the gas discharge and, on the other side, are electroconductively connected (for example, by means of a metallic contact) to an external current circuit. When an alternating voltage is applied to the capacitive electrodes, an electric alternating field is formed in the discharge vessel and the charge carriers move on the linear electric fields of said alternating field. In the high-frequency range (f>10 MHz) the capacitive lamps are similar to the inductive lamps, because in this range the charge carriers are also generated in the entire gas volume. The surface properties of the dielectric electrode are in this case less important (so-called $\alpha$ discharge mode). At lower frequencies the mode of operation of the capacitive lamps changes and the electrons which are important for the discharge must be originally emitted at the surface of the dielectric electrode and multiplied in a so-called cathode drop region so as to maintain the discharge. Consequently, the emission behavior of the dielectric material then determines the functioning of the lamp (so-called $\gamma$ discharge mode). The power deposited in the cathode drop region is not available to the generation of light and, consequently, reduces the efficiency of the lamp (lumen per Watt).

For many devices it is advantageous to use fluorescent lamps of small diameter (less than 5 mm) and an as high as possible luminous flux per unit of length of the lamp (lumen per cm). Moreover, most fields of application require a high resistance against switching transients for the lamp. This holds notably for the use of gas discharge lamps for backlighting for a liquid crystal display (LCD backlight).

Hot cathode lamps require a minimum diameter of the discharge vessel of approximately 10 mm in order to enable the coil and the anode shield to be accommodated. When the anode shield is dispensed with, inner diameters of approximately 6 mm can be realized, be it that the service life is strongly reduced due to the increased blackening. Moreover, the switching behavior of hot cathode lamps is unacceptable for many fields of application and, moreover, they can be dimmed only with difficulty.

Fluorescent gas discharge lamps having a small lamp diameter (no more than 5 mm) can thus far be realized only in the form of cold cathode lamps or in the form of capacitive gas discharge lamps with an operating frequency in the high-frequency range (higher than 1 MHz). Cold cathode lamps offer the advantage that they can be operated at low frequencies (30–50 kHz). Therefore, their electromagnetic radiation is only weak. However, the discharge current in cold cathode lamps is severely restricted (to a maximum value of approximately 10 mA). The current limitation is due to the strongly increased sputter rate of electrode material as a function of the discharge current. Moreover, the current limitation serves to prevent local heating of the electrode to such an extent that thermal emission occurs with a severely increased sputter rate. The released electrode material is then deposited in the discharge vessel and hence causes fast blackening of the lamp.

In the case of a capacitive discharge lamp with an operating frequency f>1 MHz, the high operating frequency causes, in conjunction with a high current density in the lamp (large current, small lamp diameter), strong electromagnetic radiation. This makes it necessary to take elaborate steps throughout the system formed by the lamp, reflector, drive electronics etc. in order to limit this electromagnetic radiation. Because the power is capacitively coupled in via the discharge vessel, the operating frequency is limited downwards (to approximately 1 MHz) via the capacitance of the coupling-in surface.

U.S. Pat. No. 2,624,858 discloses a capacitive gas discharge lamp provided with a dielectric layer between external electrodes and the gas discharge. The external electrodes are connected to an alternating current source which outputs a voltage of from 500 V to 10,000 V at a frequency of 120 Hz. The dielectric layer has a high dielectric constant $\epsilon$ which is greater than 100, preferably greater than 2000. The capacitive coupling in of the external alternating voltage by means of the dielectric layer causes ionization and excitation of the gas in the lamp, so that the luminous gas discharge occurs. This combination of dielectric constant and operating frequency is capable of achieving a high luminous flux of the lamp only by using coupling-in structures of very large dimensions so that the lamp overall will also be of large dimensions. Moreover, in such a lamp a high luminous flux requires an extremely high operating voltage and hence an expensive drive circuit. In addition, in this frequency range the secondary emission coefficient $\gamma$ is significantly less attractive, so that the efficiency of the gas discharge is less and a smaller amount of light is generated.

SUMMARY OF THE INVENTION

It is an object of the invention to provide a low-pressure gas discharge lamp which, in the presence of capacitive coupling-in, offers a higher efficiency in conjunction with a small structural volume, a high luminous flux, a low operating voltage, a low electromagnetic emission, a high resistance against switching transients and a long service life.

This object is achieved in that each capacitive coupling-in structure is formed by at least one dielectric having a thickness d and a dielectric constant $\epsilon$, each dielectric being subject to the condition $d/(f.\epsilon)<10^{-8}$ cm.s. The gas discharge lamp consists in known manner of a transparent discharge vessel containing a customary filling gas (for example, an inert gas or an inert gas with mercury in the case of low-pressure gas discharge lamps) and operates with an alternating current source at the operating frequency f. The material for the discharge vessel and the filling gas can be selected in conformity with the desired spectrum of the generated radiation. More specifically, the discharge vessel may also be provided with a coating, so that the lamp according to the invention emits radiation of a given frequency range (for example, in the UV range). At least two spatially separated coupling-in structures are provided on the discharge vessel. The dielectric of the capacitive coupling structure may consist of one or more layers. Each layer should individually satisfy the condition $d/(\epsilon.f)<10^{-8}$ cm.s. Evidently, a plurality of further coupling-in structures is also feasible within the scope of the invention, said structures having the features of the invention as a result of a suitable choice of a combination of material properties and geometry of the dielectric.

Advantageous embodiments of the invention are disclosed in the further claims and the embodiment according to the invention. In a preferred further embodiment of the invention at least one dielectric is subject to the condition $d/(f.\epsilon)>10^{-9}$ cm.s, so that the lamp obtains a positive current-voltage characteristic. Gas discharge lamps must be suitably provided with a ballast in order to ensure a stationary gas discharge. This ballast is usually integrated in an electric ballast device in which a circuit also generates the ignition voltage required to start the lamp. Preferably, the material of the capacitive coupling-in structures, their geometry and the operating frequency for the lamp according to the invention are chosen to be such that the mean voltage across the dielectrica corresponds approximately to the voltage across the plasma in the discharge vessel of the lamp (for $d/(\epsilon.f)\approx5.10^{-9}$ cm.s), so that the capacitive coupling-in structures can be used for ballasting the lamp. A ballast element can then be dispensed with in the lamp drive circuit, offering a substantial cost saving. Moreover, the self-ballasting of the lamp makes it possible to operate a plurality of such lamps in parallel while using a single driver; this may again lead to significant savings as regards the cost of the driver.

A lamp according to the invention overcomes the drawbacks of known lamps notably for operation in the frequency range of from 150 Hz to 1 MHz.

The dielectric material preferably has an essentially negative temperature dependency of the dielectric constant. Some dielectric materials are known for which the value of the dielectric constant decreases as the temperature rises, notably beyond a given temperature. The dielectric constant may also increase briefly particularly in the low temperature range. During operation of the lamp the dielectric is heated due to the coupling-in of power, so that the dielectric capacitance decreases and the maximum power that can be coupled in is limited. The power of the lamp is thus stabilized and ballasting of the lamp is achieved already by means of the coupling-in structure present therein.

A particularly suitable embodiment of the invention includes an essentially hollow cylindrical discharge vessel having an inner diameter $d_i$; the inner diameter $d_i$ may then be less than 10 mm. Hollow cylindrical discharge vessels are particularly attractive, because their manufacture and treatment is well known from other gas discharge lamps. Small inner diameters make the lamps easier to handle and enable many applications for the lamps. In dependence on the application, the hollow cylindrical discharge vessel may be configured, for example, as a spiral, as letters or numbers and the like. A further elaboration of the lamp also has essentially hollow cylindrical capacitive coupling-in structures which have the inner diameter $d_i$ and are connected to the discharge vessel in a compression proof manner. As a result of the use of the same dimensions, the dielectric can be particularly simply connected to the discharge vessel, for example, by means of a glass soldering technique.

The filling gas in the discharge vessel is preferably chosen to be a mixture containing at least one inert gas or an inert gas and mercury. A plurality of gas mixtures can be used as the filling gas for the lamp according to the invention. More specifically, the filling gases used in known low-pressure gas discharge lamps can be used. This offers the advantage that the handling is known. The selection of the filling gas can also be dependent on the application of the lamp, thus supporting a desired color (wavelength of the emitted radiation) or shape.

In a further embodiment of the lamp according to the invention the discharge current of the gas discharge is greater than 10 mA. The use of a large discharge current enables the generation of a luminance which is higher than in known lamps. The level of the luminance is determined by the filling gas used. Such large powers can be coupled in via the dielectrica according to the invention that the plasma in the discharge vessel reaches the highest possible luminance. For example, in the case of an inner diameter $d_i$=3 mm, the luminance can be doubled to approximately 6000 cd/m$^2$ in comparison with cold cathode lamps.

The dielectric preferably consists of a paraelectric, ferroelectric or anti-ferroelectric solid material. Particularly suitable are oxide ceramics (for example, $BaTiO_3$, $SrTiO_3$, $PbTiO_3$, $PbZrO_3$) which may also consist of a composition.

The discharge vessel in a preferred embodiment of the invention consists of a UV transparent material and is filled with an UV emitting filling gas. For example, a glass tube can be used as the UV transparent material for the discharge vessel. The discharge vessel can also be provided with a coating of a luminescent material which converts the radiation emitted by the filling gas into a desired spectrum (notably in the UV range). For example, the luminescent material may emit radiation which corresponds to the spectrum of solar radiation, so that the lamp can be used for sun tanning applications.

The object of the invention is also achieved by means of a device for backlighting of a liquid crystal display in which each capacitive coupling-in structure consists of at least one dielectric of a thickness d and a dielectric constant $\epsilon$, each dielectric being subject to the condition $d/(f.\epsilon)<10^{-8}$ cm.s.

The lamp according to the invention enables the unexpected combination of high luminance, low electromagnetic emission, low operating voltage, high resistance against switching transients and a long service life. Apart from the use in the device for backlighting, the lamp is particularly suitable for decorative and general lighting, for lighting for advertising purposes, as a light source for facsimile apparatus, scanners and copiers, as a brake light for motor vehicles, for alarm and orientation lighting and as a UV light source. As a UV light source it can be used notably for degermination/disinfection of air and water, for surface cleaning, for treatment of paint, for gluing, for curing (lacquer, adhesives), for suntanning (particularly for flat suntan apparatus) and for devices in the field of photochemicals, waste disposal and separating processes.

BRIEF DESCRIPTION OF THE DRAWINGS

Embodiments according to the invention will be described in detail hereinafter with reference to drawings. Therein.

DETAILED DESCRIPTION OF THE INVENTION

The various embodiments of the gas discharge lamps use a dielectric solid material having the properties according to the invention as the dielectric starting material for the capacitive coupling-in structure. Preferably, an oxide ceramic is used as the dielectric material of the capacitive coupling-in structures. It consists, for example of a composition of $BaTiO_3$, approximately 1% $Nb_2O_5$, and a few per thousand of $CO_3O_4$. The composite is granulated accordingly, shaped by means of a binder and subsequently sintered. The material thus produced has a dielectric constant $\epsilon$ with a temperature-dependent behavior in conformity with the diagram shown in FIG. 8. During operation of the lamp the dielectric constant remains so high that the condition $d/(\epsilon.f)<10^{-8}$ cm.s continues to be satisfied. When the temperature of the oxide ceramic during the operation of the lamp reaches a value at which the drop of the dielectric constant occurs as the temperature increases, this behavior contributes to the stabilization of the power of the lamp. This is because, if the coupled-in power were to increase, a temperature increase of the oxide ceramic would cause a strong reduction of the dielectric capacitance and hence, via an increased voltage drop, a reduction of the current and hence of the power. In other words, the lamp has a strong positive U-I characteristic.

The material for the dielectric must be slightly electron emissive at the surface facing the gas discharge. To characterize the emission properties of the dielectric, use is made of the ratio between ion current and electron current at the surface of the side of the dielectric facing the plasma. This ratio is referred to as the ion-induced secondary emission coefficient $\gamma$. Between the dielectric surface and the light-generating part of the plasma a narrow, approximately 1 mm thick plasma boundary layer is formed. The power delivery in the plasma boundary layer may assume high values, thus significantly reducing the efficiency (lumen per Watt) of the lamp. A high secondary emission coefficient $\gamma$ leads to a reduction of this power fraction, thereby increasing the efficiency of the lamp. Therefore, materials which can particularly suitably be used for the dielectric are those which demonstrate deposition of additional electrons on the surface facing the plasma during the operation of the lamp, and which lead to a secondary emission coefficient $\gamma>0.01$.

Figure 1:
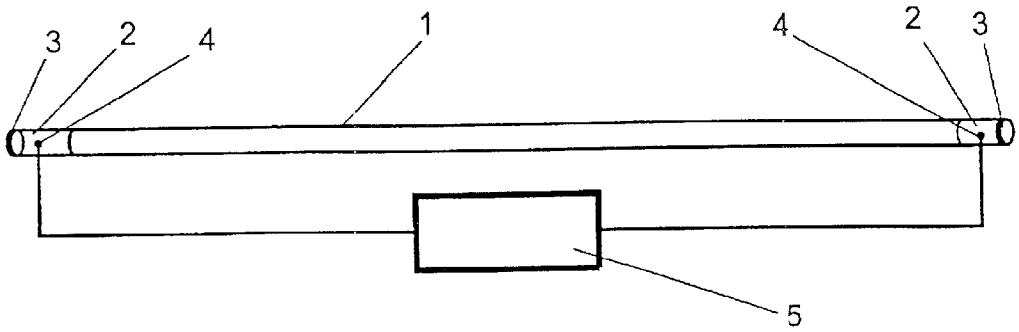
FIG. 1 shows diagrammatically a first feasible embodiment of a gas discharge lamp according to the invention.

FIG. 1 shows a capacitive gas discharge lamp comprising a glass tube 1 which serves as the gas discharge vessel. The glass tube 1, the inner surface of which is coated with phosphor, has an inside diameter of 3 mm, an outside diameter of 4 mm, a length of 40 mm and is filled with 50 mbar Ar and 5 mg Hg. A dielectric coupling-in structure at both ends is formed by a respective cylindrical tube 2 of the dielectric material (oxide ceramic satisfying the condition $d/(\epsilon.f)<10^{-8}$ cm.s). The dielectric cylinder 2 has an outside diameter of 4 mm, a wall thickness of 0.5 mm and a length of 10 mm. The glass tube 1 is sealed, via the coupling-in structure 2 which has the same inside diameter, to a disc-shaped, dielectric cap 3 in a vacuumtight manner by means of a soldering operation. The dielectric cylinder 2 is provided with a layer of silver paste which has been burned in advance, thus enabling electrical contacting 4. The lamp is connected to an external power mains via the contact 4. In this embodiment the external power mains is a lamp driver circuit 5 which supplies a current of 30 mA at 40 kHz and a mean voltage of approximately 350 V. In the steady mode the lamp delivers a light current of approximately 600 lumen. The driver 5 also includes a section for igniting the lamp which is capable of briefly delivering voltages of 1500 V. After the ignition, a stationary gas discharge is formed. Electrons reach the surface of the dielectric material and adhere thereto, thus increasing the ion induced secondary emission coefficient $\gamma$. The efficiency of the gas discharge lamp is thus enhanced. After a short period of time the dielectric reaches such high temperatures that the dielectric constant $\epsilon$ is in the range of the negative slope of the diagram shown in FIG. 8. This property can be utilized so as to stabilize the lamp in relation to the coupled-in power.

Figure 2:
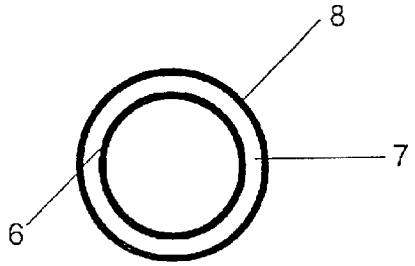
FIG. 2 is a diagrammatic sectional view of a dielectric coupling-in structure.

FIG. 2 is a diagrammatic sectional view of a coupling-in structure according to the invention. The sectional view was taken at the area of the dielectric tube 2. The interior space, filled with a filling gas, is enclosed by a first dielectric layer 6 which is adjoined by a second dielectric layer 7 of $BaTiO_3$. A metallization 8 which serves for electrical contacting is provided on the dielectric layers. The thickness of the dielectric layer 6 may be very small (coating), because it can be deposited on a layer 7 which acts as a substrate.

Figure 3:
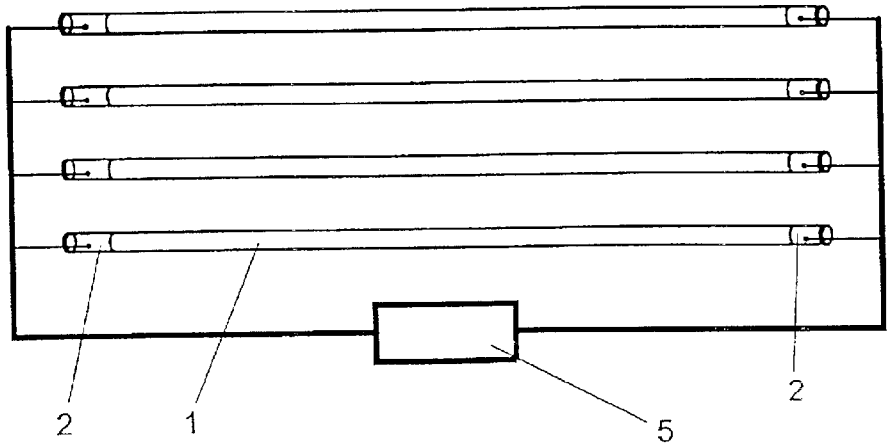
FIG. 3 shows a parallel arrangement of a plurality of lamps with a common driver circuit.

FIG. 3 shows four lamps, each of which is provided with the discharge vessels 1 and coupling-in structures 2 shown in FIG. 1, which lamps are operated in parallel via a common driver circuit 5. Because each individual lamp is provided with a stabilizing feedback due to the material properties of the dielectric, acting as self-ballasting, use can be made of a common driver circuit 5. A separate ballast device with an ignition circuit and a ballast is not required for each lamp.

Figure 4:
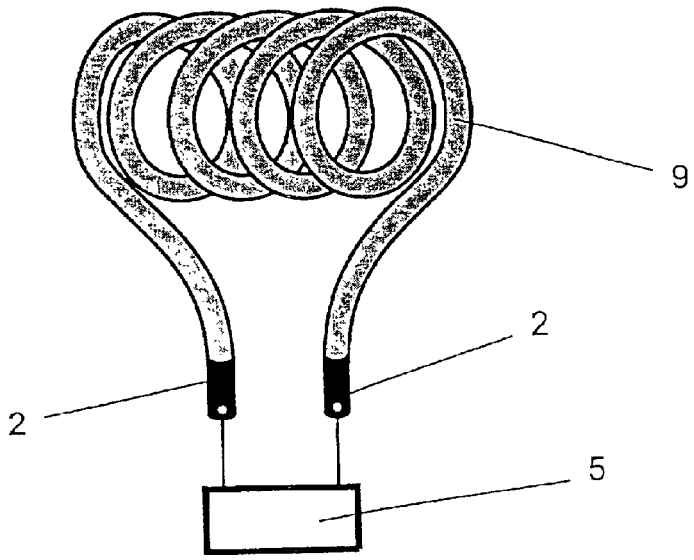
FIG. 4 shows a further feasible embodiment of the gas discharge lamp according to the invention.

FIG. 4 shows a lamp which has the specifications of the lamp of FIG. 1 and has been bent so as to form a coil. Respective coupling-in structures 2 are provided at the ends of the coil 9, said structures being connected to a driver circuit 5. This results in a decorative lamp with luminances which far surpass those of the known energy-saving lamps. Evidently, many other shapes are also feasible for the lamp of FIG. 1. Further applications as miniaturized decorative lamps with a significantly higher luminance than known fluorescent lamps are also feasible (for example, for compact shelve lighting). To this end, the discharge tube can be bent as desired, without the lamp properties being modified. A suitable choice of the filling gas and/or phosphor layer of the discharge vessel, moreover, enables the generation of radiation in a desired wavelength range. The gas discharge lamp having the dimensions of FIG. 1 can be filled, for example with 25 mbar of pure neon. Such a lamp can also be used as a red brake light behind the rear window of a passenger car. In the automotive field the lamp according to the invention can also be used for other purposes (for example, also as a blinking light, for interior lighting or instrument illumination etc.). A further attractive application of the lamp consists in the use as an alarm and orientation lamp, because such applications require not only an as low as possible power consumption but also given shapes and colors.

Irrespective of the shape of the lamp, the gas discharge lamp according to the invention is particularly suitable as a UV radiation source and for all known fields of application of UV radiation sources. The discharge vessel 1 of the lamp is filled with a suitable filling gas (for example, inert gas and mercury) and consists in known manner of a UV transparent material (for example, a glass tube). The glass tube may also be provided with a suitable luminescent material on its inner side or its outer side, said luminescent material producing a desired UV spectrum. The described advantages of the gas discharge lamp with a capacitive coupling in according to the invention enable the realization of UV light sources with a particularly high UV light yield per lamp length and a particularly compact construction, and with a low electromagnetic emission, a high resistance against switching transients, a high efficiency, a low operating voltage and a long service life in comparison with known low-pressure gas discharge UV radiation sources. Therefore, a lamp thus constructed offers significant advantages over known devices in devices for applications involving UV radiation sources. It is particularly suitable for devices for the degermination/disinfection of air and water, for surface cleaning, for paint treatment, for gluing, for curing (lacquers, adhesives), for suntanning (realization of particularly compact/flat suntanning apparatus), and for devices in the field of photochemistry, waste disposal and separation processes.

Figure 5:
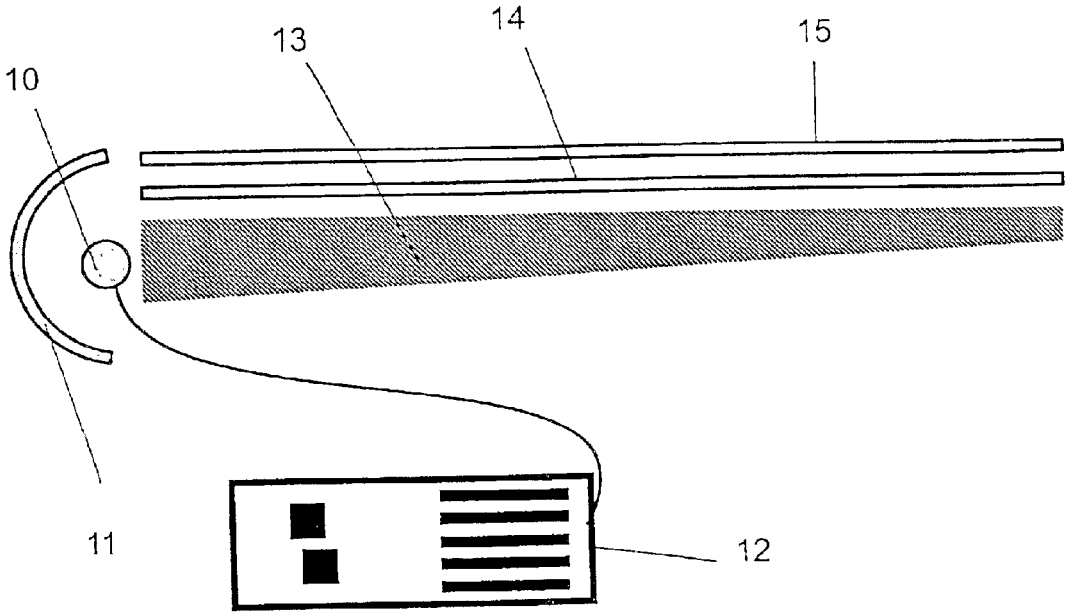
FIG. 5 shows diagrammatically a device for backlighting of a liquid crystal display.

FIG. 5 is a diagrammatic view of a device for backlighting of a liquid crystal display. A lamp 10 as described with reference to FIG. 1 is used for laterally radiating light into a light conductor 13 of a 15" LCD backlight. The device consists of a driver circuit 12 which is connected to a low-pressure gas discharge lamp 10. The lamp 10 is provided with a reflector 11 which radiates the light into the light conductor 13 wherefrom it is coupled out by means of a rear area, structured reflector plate, to the liquid crystal display (LCD panel) in the forward direction, via a diffuser 14 and a reflective polarization filter 15. The liquid crystal display has been omitted for the sake of clarity. For example, LCDs of known construction can be used. Due to the higher quantity of lumen per lamp length, for example, in comparison with a cold cathode lamp double the amount of light can be obtained on the LCD display screen, without it being necessary to take additional steps in respect of electromagnetic interference, because the operating frequency remains the same.

Figure 6:
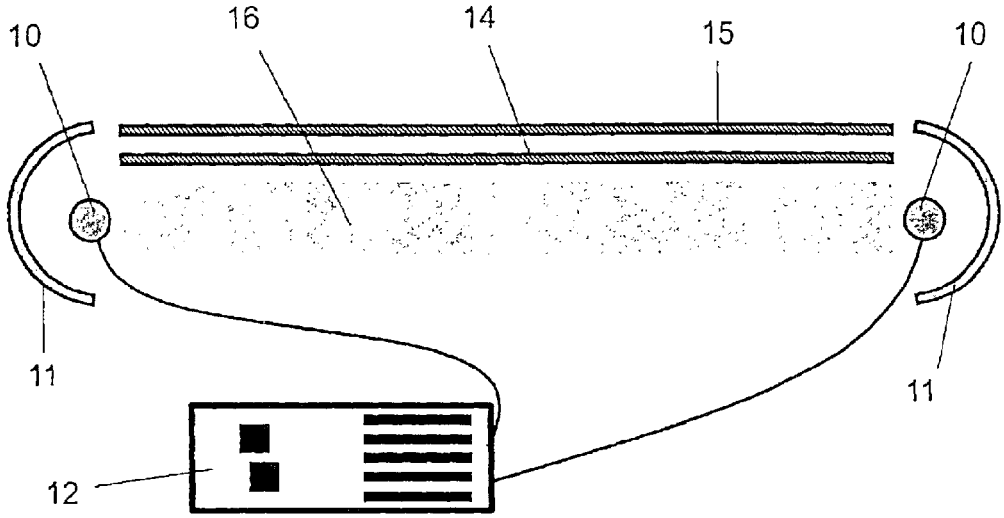
FIG. 6 shows diagrammatically a further device for backlighting of a liquid crystal display.

FIG. 6 shows a similar device for the backlighting of a liquid crystal display. Two lamps 10 as described with reference to FIG. 1 are used for laterally radiating light into a light conductor 16 of a 15" LCD backlight. The light of the lamps 10 is coupled into the light conductor 16 from two sides by means of the reflectors 11 and coupled out in the forward direction towards the LCD panel via a diffuser 14 and a reflective polarization filter 15. Because of the larger quantity of lumen per lamp length, double the amount of light, for example, in comparison with a cold cathode lamp, can again be obtained on the LCD display screen, without it being necessary to take additional steps in respect of electromagnetic interference, because the operating frequency remains the same. If desired, two cold cathode lamps (at the right-hand side and the left-hand side of the light conductor 16) can be replaced by a single capacitive lamp 10 which produces the same brightness values on the LCD display screen. When at least two capacitive lamps 10 are used, because of their self-ballasting they can be operated by means of a single electronic driver circuit 12. In addition to a saving of every second lamp, a saving is then also achieved in respect of the costs of the driver 12 as well as a higher degree of protection against failure because number of lamps used is smaller.

Figure 7:
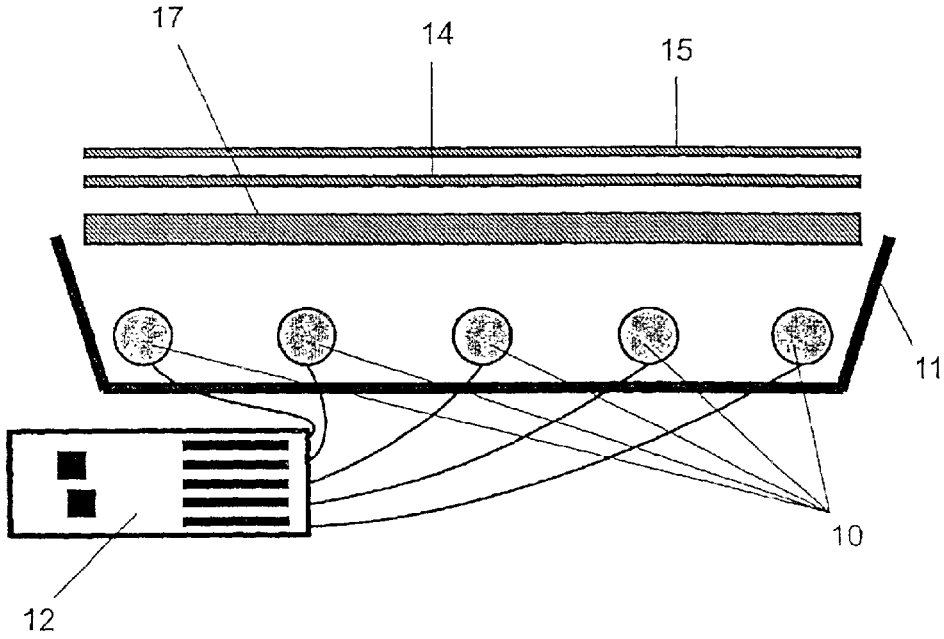
FIG. 7 shows diagrammatically a third device for backlighting of a liquid crystal display.

In the device for backlighting of a liquid crystal display as shown in FIG. 7 a plurality of lamps as described with reference to FIG. 1 is used for projection of light from the rear into a light conductor of an 18" LCD backlighting. The lamps 10 are arranged in a reflector 11. The light of the individual lamps 10 is homogenized by means of an optical filter 17 and a diffuser 14 and subsequently traverses a reflective polarization filter 15 before being coupled out to the LCD panel (not shown). The optical filter 17 prevents the light from the lamps 10 from being incident directly on the diffuser 14. As a result of the larger quantity of lumen per lamp length, double the amount of light, for example, in comparison with a cold cathode lamp, can again be obtained on the LCD display screen, without it being necessary to take additional steps in respect of electromagnetic interference, because the operating frequency remains the same. If desired, two cold cathode lamps can again be replaced by a single capacitive lamp 10 which produces the same brightness values on the LCD display screen. Because of their self-ballasting, all capacitive lamps 10 can operate with a single electronic driver circuit.

Figure 8:
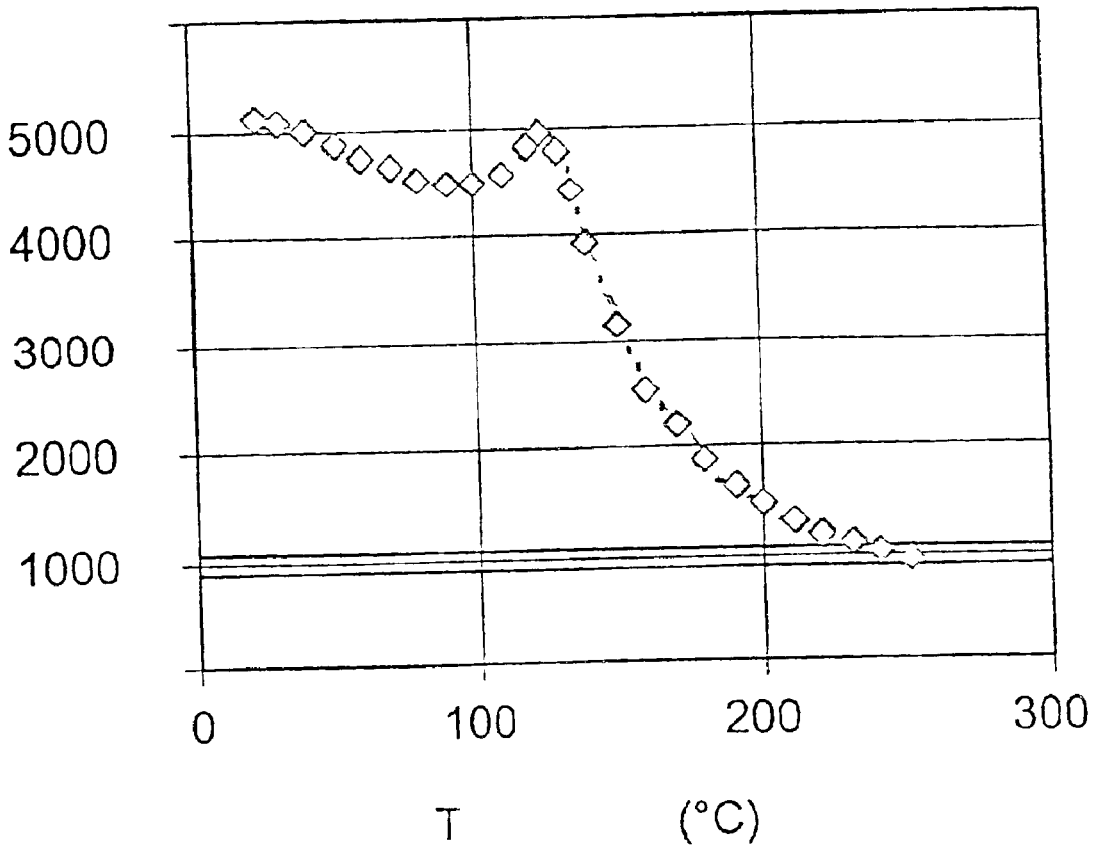
FIG. 8 shows a diagram illustrating the variation of the dielectric constant $\epsilon$ of an oxide ceramic as a function of temperature.

FIG. 8 shows a diagram illustrating the variation as a function of temperature of the dielectric constant $\epsilon$ of an oxide ceramic of $BaTiO_3$, approximately 1% $Nb_2O_5$ and a few per thousand of $CO_3O_4$. When a suitable thermal bond is formed between the lamp holder and the ceramic, a ceramic temperature of more than 130° C. can be realized during stationary operation of the lamp. At this temperature the dielectric constant $\epsilon$ fluctuates around very large values of approximately 5000. When the temperature of the dielectric increases further due to the coupling-in of power, the essentially negative temperature coefficient of the dielectric material causes a strong drop of the dielectric constant. As a result, the dielectric capacitance of the coupling-in structure decreases, so that a higher voltage drops across the dielectric and a smaller current flows. Less power can then be coupled into the discharge vessel, leading to a reduction of the temperature in the dielectric. This negative feedback leads to enhanced stabilization and ballasting of the lamp in the stationary mode of operation.

What is claimed is:

1. A high-efficiency low-pressure gas discharge lamp which includes a discharge vessel and at least two spatially separated capacitive coupling-in structures and operates at an operating frequency f, wherein each capacitive coupling-in structure is formed by at least one dielectric having a thickness d and a dielectric constant $\epsilon$, each dielectric being subject to the condition $d/(f.\epsilon)<10^{-8}$ (cm)(seconds) thereby providing a high luminous flux in a small structural volume.

2. A low pressure gas discharge lamp as claimed in claim 1, wherein at least one dielectric is subject to the condition $d/(f.\epsilon)>10^{-9}$ (cm)(seconds) thereby allowing the at least two spatially separated capacitive coupling-in structures to operate as a ballast.

3. A low pressure gas discharge lamp as claimed in claim 1, wherein the operating frequency f is in the range of from 150 Hz to 1 MHz.

4. A low pressure gas discharge lamp as claimed in claim 1, wherein the dielectric constant of the dielectric has an essentially negative temperature dependency.

5. A low pressure gas discharge lamp as claimed in claim 1, wherein the discharge vessel is shaped essentially as a hollow cylinder having an inside diameter $d_i$ which is smaller than 10 mm.

6. A low pressure gas discharge lamp as claimed in claim 5, wherein the capacitive coupling-in structure is shaped essentially as a hollow cylinder, has an inside diameter $d_i$ and is connected to the discharge vessel in a compression proof manner.

7. A low pressure gas discharge lamp as claimed in claim 1, wherein the discharge vessel is filled with a filling gas containing at least one inert gas.

8. A low pressure gas discharge lamp as claimed in claim 7, wherein the filling gas contains mercury.

9. A low pressure gas discharge lamp as claimed in claim 1, wherein the operating frequency f is less than 150 kHz.

10. A low pressure gas discharge lamp as claimed in claim 1, wherein the discharge current of the gas discharge is more than 10 mA.

11. A low pressure gas discharge lamp as claimed in claim 1, wherein the dielectric consists of a paraelectric, ferroelectric or anti-ferroelectric solid material.

12. A low pressure gas discharge lamp as claimed in claim 1, wherein the discharge vessel consists of an UV transparent material and is filled with a filling gas emitting UV.

13. A device for the backlighting of a liquid crystal display, including at least one low-pressure gas discharge lamp with a discharge vessel, at least two capacitive coupling-in structures, operating at an operating frequency f, as the light source, and an optical system for producing backlighting, wherein each capacitive coupling-in structure consists of at least one dielectric having a thickness d and a dielectric constant $\epsilon$, each dielectric being subject to the condition $d/(f.\epsilon)<-8$ (cm)(seconds) thereby providing a high luminous flux in a small structural volume.

* * * * *